US007530375B2

(12) United States Patent
Aitken et al.

(10) Patent No.: US 7,530,375 B2
(45) Date of Patent: May 12, 2009

(54) FUEL FILLER NOZZLE FOR AUTOMOTIVE VEHICLE

(75) Inventors: Brian Aitken, Livonia, MI (US); Robert Beier, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 241 days.

(21) Appl. No.: 11/427,035

(22) Filed: Jun. 28, 2006

(65) Prior Publication Data

US 2008/0000544 A1 Jan. 3, 2008

(51) Int. Cl.
*B65B 1/04* (2006.01)

(52) U.S. Cl. ..... 141/371; 141/98; 141/372

(58) Field of Classification Search ..... 141/1, 141/59, 98, 192, 348–350, 369–372, 382–386, 141/390–392
See application file for complete search history.

(56) References Cited

U.S. PATENT DOCUMENTS 3,527,268 A * 9/1970 Binsburgh ..... 141/98
3,642,036 A * 2/1972 Ginsburgh et a. ..... 141/94
3,719,215 A 3/1973 Murray
3,734,149 A 5/1973 Hansel
3,885,608 A 5/1975 Ayres
5,056,570 A 10/1991 Harris et al.
5,069,260 A 12/1991 Shea
5,271,438 A 12/1993 Griffin et al.
5,609,190 A * 3/1997 Anderson et al. ..... 141/59
5,634,505 A 6/1997 Wong
5,638,875 A * 6/1997 Corfitsen ..... 141/360
5,732,840 A 3/1998 Foltz
6,009,920 A 1/2000 Palvoelgyi et al.
6,250,348 B1 6/2001 Reinholdt
RE37,776 E 7/2002 Foltz
6,418,985 B2 * 7/2002 Aguilar ..... 141/98
6,962,177 B1 11/2005 McCommons
6,968,875 B2 11/2005 Nielsen

* cited by examiner

*Primary Examiner*—Timothy L Maust
(74) *Attorney, Agent, or Firm*—Dickinson Wright PLLC; Greg Brown

(57) ABSTRACT

A fuel filler nozzle for an automotive vehicle includes an axially insertable guide spud for opening a capless filler pipe closure device. A vacuum shroud is mounted to the guide spud, and a fuel supply tube is telescopically mounted within the guide spud and the shroud. The fuel supply tube has a retracted position within the guide spud and an extended position in which a flexible portion of the fuel supply tube extends through the vacuum shroud and guide spud.

8 Claims, 4 Drawing Sheets

FUEL FILLER NOZZLE FOR AUTOMOTIVE VEHICLE

BACKGROUND OF THE INVENTION

1. Field of the Invention

The present invention relates to a filler nozzle for placing gasoline in a fuel tank of a motor vehicle, and more particularly, to placing fuel within a motor vehicle equipped with a capless filler pipe closure device.

2. Disclosure Information

Since the dawn of the automotive age, vehicles have been equipped with fuel tanks having fill pipes with capped ends. Unfortunately, removing and replacing fuel caps tends to be a burdensome task for many motorists and, as a result, capless fuel pipe closure devices have been proposed. One such device is shown in U.S. Pat. No. 5,056,570, and another in U.S. Reissue Pat. No. RE 37,776E. With these devices, as well as other capless devices, it is necessary that a fuel pump nozzle be inserted into the capless closure device a sufficient distance, and with sufficient force, to cause a sealed trap door located within the capless closure device to open, thereby allowing further insertion of the fuel pump nozzle.

Because of the need to exclude contamination from vehicle fuel systems, as well as the need to avoid inadvertent opening of the tank, the force required to open capless devices is not insignificant.

During vehicle manufacturing, it is of course necessary to put a factory fill of fuel in the tank of each vehicle leaving an assembly line. Because many vehicle assembly line speeds typically approach 60 jobs per hour or more, fuel filling must be accomplished in a very short period of time. As a consequence, very high fill rates are employed. In order to accommodate such high fill rates, it is necessary that the fuel be introduced at some distance down the filler pipe past the point at which the fuel cap, or in this case, the capless closure device, attaches. This necessitates that the end of the factory filler nozzle be equipped with flexible tubing, such as plastic or metal flexible tubing, because flexible tubing has the ability to curve into the fill pipe. Unfortunately, this requirement for flexibility presents a problem because a flexible fill pipe cannot push through the trap door found in proposed or conventional capless fill pipe closure devices. Moreover, because of its inherent deformability, a flexible filler nozzle extension may become trapped within the capless closure device by the action of the device's trap door. A nozzle according to the present invention overcomes these problems, while allowing the high fill rate needed during factory filling of a vehicle.

SUMMARY

A fuel filler nozzle for an automotive vehicle includes a generally tubular, axially insertable guide spud for opening a capless filler pipe closure device. A generally tubular vacuum shroud is mounted to the guide spud. A fuel supply tube extends through the vacuum shroud and is telescoped into the guide spud. The fuel supply tube has a retracted position in which the fuel supply tube does not extend from the guide spud, and an extended position, for introducing fuel into a filler pipe, in which the fuel tube extends through the vacuum shroud and through the guide spud and into the filler pipe. The guide spud and the vacuum shroud may either be unitary, or the vacuum shroud may be slidably mounted to the guide spud upon rails, or otherwise. In the event that the vacuum shroud is mounted to the guide spud by means of rails, each of the rails may be equipped with a resilient separator, such as a compression spring, for maintaining clearance between the shroud and the guide spud. The resilient separator may comprise not only a compression spring, but, alternatively, an air spring, or another type of resilient device known to those skilled in the art and suggested by this disclosure.

According to another aspect of the present invention, slide locks are interposed between the vacuum shroud and the rails which mount the shroud to the guide spud. These slide locks are activated to prevent relative movement of the vacuum shroud with respect to the guide spud when the fuel supply tube is in its retracted position as well as when the fuel supply tube is in its extended position.

The present fuel nozzle also includes control switches interposed between the guide spud and vacuum shroud and also between the vacuum shroud and the fuel supply tube.

According to another aspect of the present invention, a method for filling a fuel tank of an automotive vehicle equipped with a filler pipe having a capless closure device includes the steps of inserting a generally tubular guide spud portion of a nozzle into the capless closure device so as to open the closure device, and extending a flexible fuel supply tube telescopically from the guide spud into fuel tank filler pipe. The method also includes pumping fuel into the tank and withdrawing the fuel supply tube into the guide spud after the fuel has been introduced into the tank. Finally, the nozzle is removed from the capless closure device after the fuel supply tube has been withdrawn into a telescoped position within the guide spud. A method for filling a fuel tank according to the present invention may further include the step of extracting fugitive fuel vapor from the vicinity of the capless closure device when the fuel supply tube is extended into the fuel filler pipe.

It is an advantage of a system according to the present invention that a vehicle may be rapidly fueled using a flexibly tipped nozzle, even if the vehicle's fuel tank fill pipe is equipped with a capless fuel filler closure device.

It is a further advantage of the present invention that known factory-fill nozzles may be modified according to this invention, without the need for purchasing all new factory-fill equipment.

Other advantages, as well as features and objects of the present invention will become apparent to the reader of this specification.

DETAILED DESCRIPTION OF THE PREFERRED EMBODIMENTS

Figure 1:
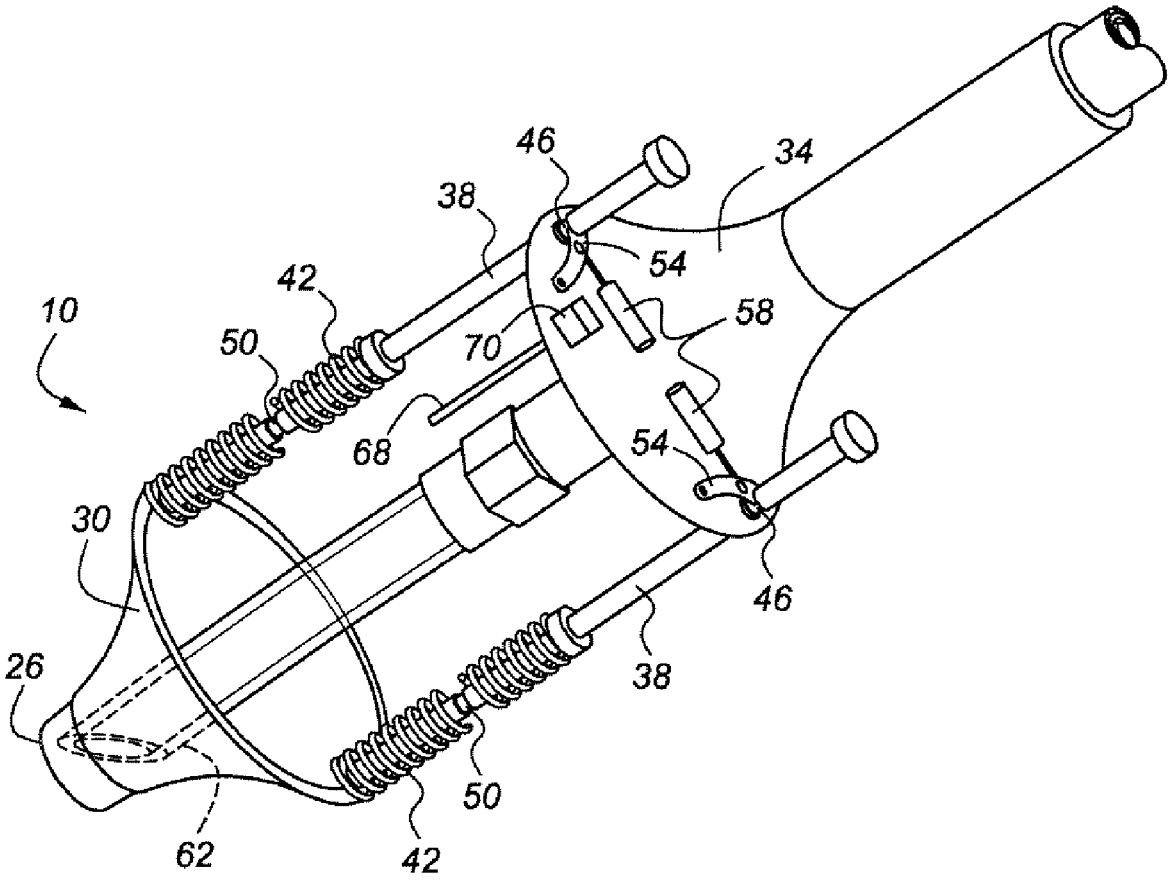
FIG. 1 is a perspective view of a fuel filler nozzle according to the present invention.
Figure 2:
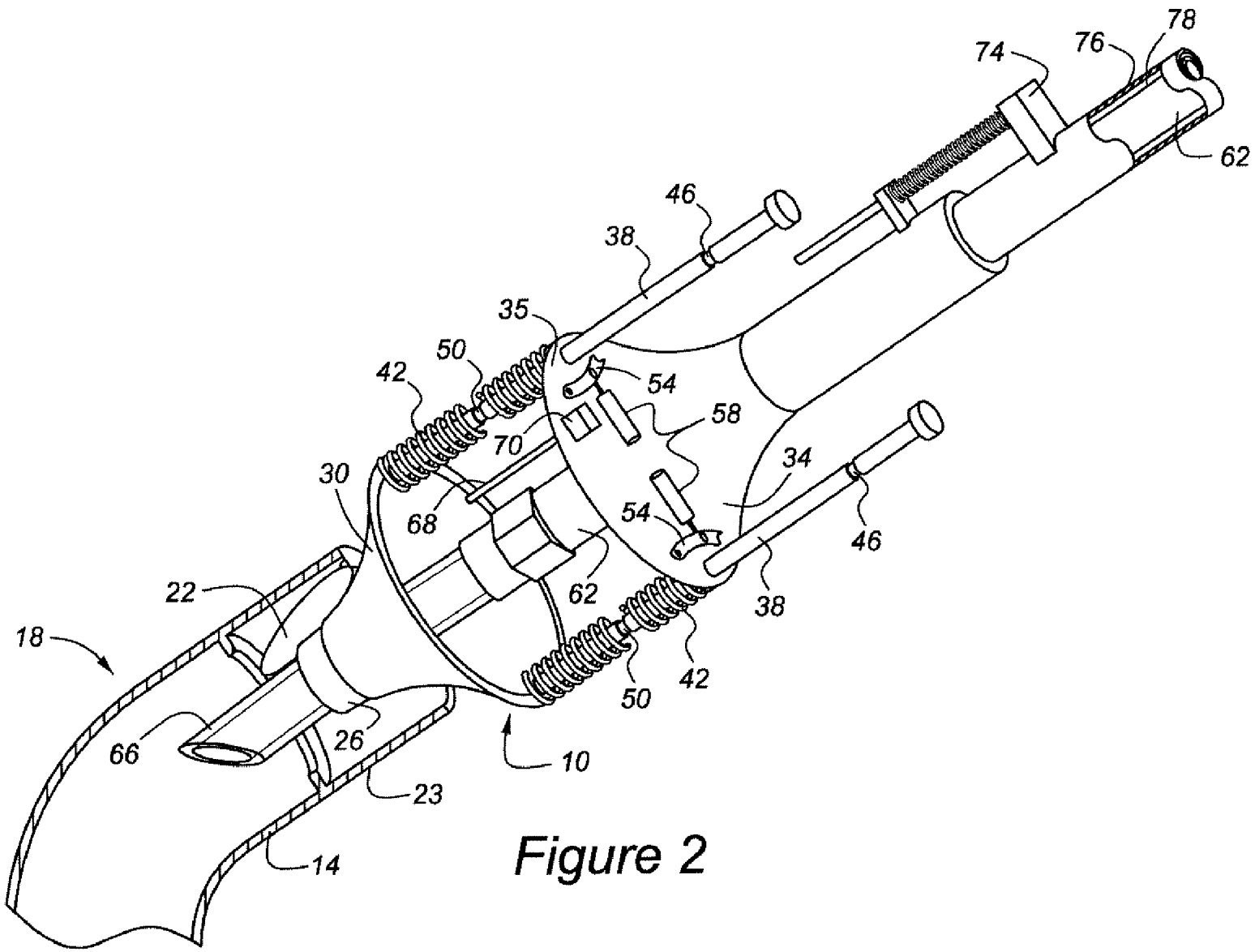
FIG. 2 is a perspective view of the present filler nozzle having been partially inserted into a fuel filler pipe having a capless closure device.
Figure 3:
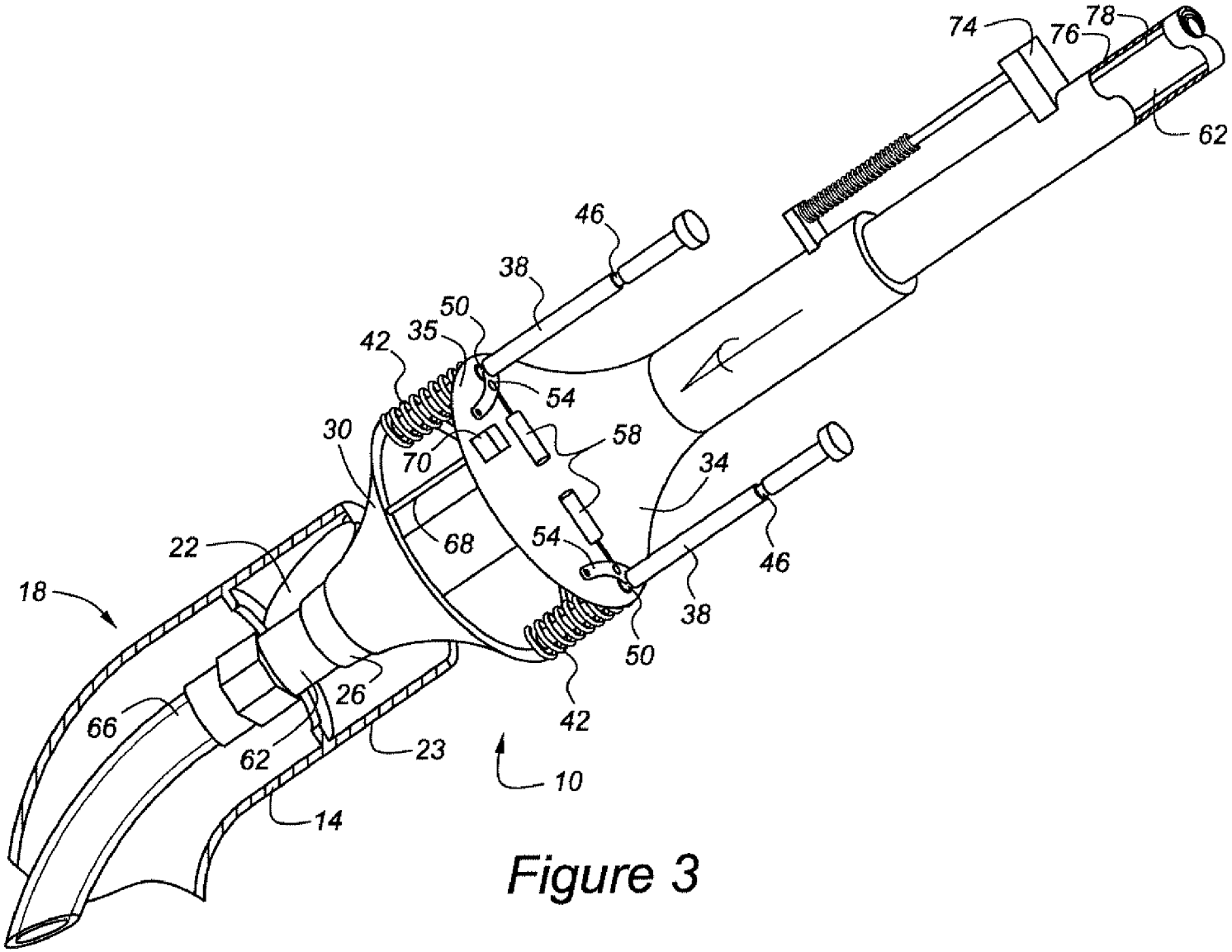
FIG. 3 illustrates the nozzle of FIGS. 1 and 2 in fully inserted position.

As shown in FIG. 1, nozzle assembly 10 has a generally tubular, axially insertable guide spud 26, for opening capless filler pipe closure devices of the type shown at 23 in FIGS. 2 and 3. Spud 26 has a bell mouth 30, to which two mounting rails, 38, are attached. Vacuum shroud 34, which has a matching bell mouth, 35, is also attached to mounting rails 38. Vacuum shroud 34 is movable axially relative to spud 26 by sliding shroud 34 along rails 38. The relative position of shroud 34 with respect to spud 26 is determined by compression springs 42, which are mounted upon rails 38, as well as by slide lock latches 54 which cooperate with grooves 46 and 50 formed in rails 38 to precisely position vacuum shroud 34 upon rails 38. For the sake of clarity, springs 42 are shown as being broken away in the area of grooves 50 of FIGS. 1 and 2.

As shown first in FIG. 1, rails 38 have upper annular grooves 46 cut in their outside surfaces. These annular grooves cooperate with slide lock latches 54, which are operated by air cylinders 58, to lock vacuum shroud 34 upon rails 38, so as to prevent relative movement of shroud 34 with respect to spud 26. When vacuum shroud 34 is positioned as shown in FIG. 1, fuel nozzle 10 is configured for insertion into a fuel filler pipe. Note, too, in FIG. 1, that fuel supply tube 62, having a flexible tip 66, is in a retracted position in which fuel supply tube 62 and particularly, flexible tip 66 are telescoped into guide spud 26. Thus, the relatively more rigid structure of guide spud 26 is available to push through trap door 22 of capless closure device 23, as shown in FIG. 2.

In the spatial relationship depicted in FIG. 2, spud 26 has pushed trap door 22, located within capless fill pipe closure device 23, to an open position. Moreover, flexible tip 66 of fuel supply tube 62 has been inserted into filler pipe 14. Those skilled in the art will appreciate in view of this disclosure that capless closure device 18 may have a variety of different constructions, such as trap doors which swing open to the inside or sideways, or perhaps, diaphragm or iris designs. In a common thread, all such devices require not insubstantial force to push a filler nozzle through the capless closure device, and this prevents the use of a flexible pipe in the absence of the present invention.

In the state of insertion shown in FIG. 2, vacuum shroud 34 is in an unlocked position because once guide spud 26 has been pushed into position within capless closure device 18, slide lock latches 54 are released by latch operating cylinders 58 and vacuum shroud 34 is allowed to slide down guide rails 38, against the force of springs 42, in the direction of guide spud 26. When vacuum shroud 34 has reached a certain position, springs 42 will be compressed, and ultimately, shroud 34 will be in its lower position, and when this position is reached, slide lock latches 54 will be locked in lower annular grooves 50 by air cylinders 58. The air cylinders may be operated by a controller or manually; this detail is beyond the scope of the present invention. Moreover, slide lock latches 54 could be operated by hydraulic cylinders, or by linear motors, or by other actuators known to those skilled in the art and suggested by this disclosure.

In the illustration of FIG. 3, shroud 34 is shown as being locked by slide lock latches 54 in cooperation with lower annular grooves 50 in mounting rails 38. Also, switches 70 and 74 are closed. Switch 70 is interposed between bell mouth 30 of guide spud 26 and bell mouth 35 of vacuum shroud 34. Switch 70 is actuated by pushrod 68, which is part of switch 70. Switch 74, on the other hand, is interposed between vacuum shroud 34 and fuel supply tube 62. When switch 70 closes, springs 42 have been completely compressed. Thereafter, further insertion of fuel supply tube 62 will cause switch 74 to close, advising the operator of the nozzle that the system is ready to provide fuel to the vehicle's fuel tank.

Figure 4:
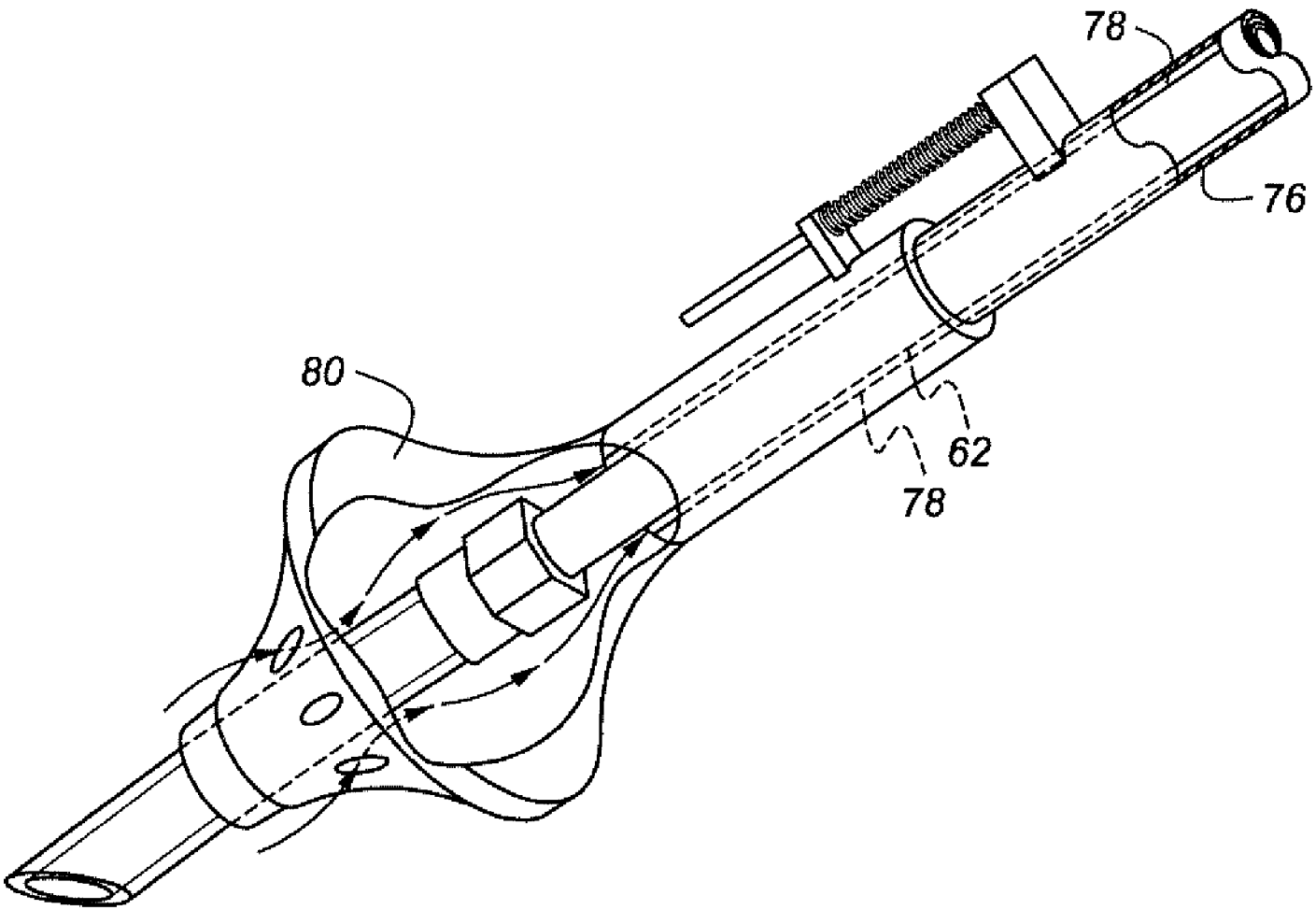
FIG. 4 illustrates a second embodiment of the present nozzle having a unitary guide spud and vacuum shroud.

FIG. 4 illustrates an embodiment in which a one-piece vacuum shroud and guide spud, 80, is provided. According to another aspect of the present invention, in the embodiment of FIG. 4, a partial vacuum is pulled in the vicinity of bell mouth 30 of guide spud 26 by means of an annular vacuum chamber, 78 formed around fuel tube 62 by outer housing tube 76. Although this aspect of the present invention is shown only with respect to FIG. 4, those skilled in the art will appreciate in view of this disclosure that such a vacuum collection feature may be employed with the embodiment of FIGS. 1-3.

According to another aspect of the present invention, a method for refueling a vehicle includes the steps of inserting nozzle assembly 10 having guide spud 26 into capless closure device 18, and then releasing slide locks on rails 38, so as to allow the shroud 34 to be moved relative to guide spud 26, while fuel supply tube 62 and flexible end 66 are inserted into fill pipe 14. Then, with springs 42 fully compressed and slide lock latches 54 engaged within grooves 50, and with contact switches 70 and 74 closed, fuel may be introduced into fill pipe 14. Thereafter, fuel supply tube 62 and flexible tip 66 will be withdrawn from fuel pipe 14, and particularly from closure device 18, and then fuel nozzle 10 will be removed from the capless closure device.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A fuel filler nozzle for an automotive vehicle, comprising:

a generally tubular, axially insertable guide spud for opening a capless filler pipe closure device;

a generally tubular shroud mounted to said guide spud, wherein said shroud comprises a vacuum shroud which is slidably mounted to said guide spud upon a plurality of rails, with each of said rails having a resilient separator for maintaining a clearance between the shroud and the guide spud; and a fuel supply tube having at least a retracted position in which the fuel supply tube extends through said shroud and is telescoped into said guide spud, and an extended position, for introducing fuel into a filler pipe, in which the fuel tube extends through said shroud and said guide spud and into said filler pipe.

2. A fuel filler nozzle according to claim 1, wherein said guide spud and said shroud are unitary.

3. A fuel filler nozzle according to claim 1, further comprising a slide lock interposed between said shroud and at least one of said rails, with said slide lock being activatable when said fuel supply tube is in said retracted position, as well as when the fuel supply tube is in said extended position.

4. A fuel filler nozzle according to claim 3, further comprising a fuel flow control switch positioned between said shroud and said fuel supply tube, with said flow control switch being operated by a resiliently loaded plunger.

5. A fuel filler nozzle according to claim 1, wherein said fuel supply tube has a flexible end extending into said filler pipe.

6. A fuel filler nozzle according to claim 1, wherein said resilient separator comprises a compression spring.

7. A fuel filler nozzle according to claim 1, wherein said resilient separator comprises an air spring.

8. A fuel filler nozzle according to claim 1, wherein adjoining ends of said guide spud and said shroud are bell-mouthed.

* * * * *